US009435166B2

(12) United States Patent
Macdonald et al.

(10) Patent No.: US 9,435,166 B2
(45) Date of Patent: Sep. 6, 2016

(54) METHOD FOR ALIGNING MWD TOOL USING ORIENTING HANGER ASSEMBLY

(71) Applicant: GE Energy Oilfield Technology, Inc., Farnborough (GB)

(72) Inventors: Craig Macdonald, Houston, TX (US); Mark Miller, Houston, TX (US)

(73) Assignee: GE Energy Oilfield Technology, Inc., Houston, TX (US)

( * ) Notice: Subject to any disclaimer, the term of this patent is extended or adjusted under 35 U.S.C. 154(b) by 73 days.

(21) Appl. No.: 14/271,059

(22) Filed: May 6, 2014

(65) Prior Publication Data

US 2015/0322739 A1 Nov. 12, 2015

(51) Int. Cl.

| | |
|---|---|
| ***E21B 23/00*** | (2006.01) |
| ***E21B 47/01*** | (2012.01) |
| ***E21B 47/024*** | (2006.01) |

(52) U.S. Cl.

CPC ..... *E21B 23/00* (2013.01); *E21B 47/01* (2013.01); *E21B 47/024* (2013.01)

(58) Field of Classification Search

CPC ..... E21B 23/00; E21B 47/01; E21B 47/12
See application file for complete search history.

(56) References Cited

U.S. PATENT DOCUMENTS

| | | | | |
|---|---|---|---|---|
| 4,681,160 | A | 7/1987 | Fineberg | |
| 5,348,091 | A | 9/1994 | Tchakarov et al. | |
| 6,173,793 | B1 | 1/2001 | Thompson et al. | |
| 6,257,339 | B1 | 7/2001 | Haugen et al. | |
| 7,429,934 | B2 | 9/2008 | Sim et al. | |
| 7,506,700 | B1 | 3/2009 | Harvey et al. | |
| 8,474,548 | B1 | 7/2013 | Young et al. | |
| 9,038,739 | B2 * | 5/2015 | Manwill | E21B 23/01 166/382 |
| 2003/0056984 | A1 | 3/2003 | Smith et al. | |
| 2004/0251048 | A1 | 12/2004 | Kurkoski | |
| 2006/0214814 | A1 | 9/2006 | Pringnitz et al. | |
| 2007/0227780 | A1 | 10/2007 | MacPherson et al. | |
| 2014/0048332 | A1 | 2/2014 | Schmidt et al. | |
| 2015/0218938 | A1 * | 8/2015 | Weisbeck | E21B 47/06 73/152.46 |

FOREIGN PATENT DOCUMENTS

WO 2011011399 A2 1/2011

OTHER PUBLICATIONS

International Search Report and Written Opinion issued in connection with related PCT Application No. PCT/US2014/037002 dated Feb. 5, 2015.

International Search Report and Written Opinion issued in connection with corresponding PCT Application No. PCT/US2015/028716 dated Nov. 26, 2015.

U.S. Appl. No. 14/271,052, filed May 6, 2014, Macdonald et al.

* cited by examiner

*Primary Examiner* — Shane Bomar
(74) *Attorney, Agent, or Firm* — GE Global Patent Operation

(57) ABSTRACT

Methods are disclosed for deploying a retrievable MWD tool in a non-retrievable environment and aligning a selected orientation of an MWD tool, as deployed in a bottom hole assembly (BHA), with a selected orientation on a tool face on the BHA. Preferred methods include providing an orienting hanger assembly (comprising a tubular inner hanger, a tubular outer collar, and a tool adapter) and attaching an MWD tool to the tool adapter. The outer collar is inserted into a BHA and the selected tool face orientation is marked on the outer collar. The inner hanger is rotated within the outer collar to align (via the alignment notch) the high side of the MWD tool to the tool face orientation transferred onto the outer collar. The inner hanger is locked to the outer collar.

20 Claims, 4 Drawing Sheets

100
121
130
122
127
135
134
129
124
135
126
136
120
137
131
131
132
133
128
125
132
123
151
153
155
153
150
152
160
106
108
105
109
107
110

METHOD FOR ALIGNING MWD TOOL USING ORIENTING HANGER ASSEMBLY

RELATED APPLICATIONS

None.

FIELD OF THE INVENTION

This disclosure is directed generally to the deployment of measurement-while-drilling tools in subsurface drilling applications, and more specifically to an orienting hanger assembly for improved deployment of such measurement-while-drilling tools in such applications.

BACKGROUND

Measurement-While-Drilling (MWD) systems are well-known in drilling technology. The term "measurement-while-drilling" encompasses a wide array of different tools and instruments having a corresponding wide array of functions. For purposes of example in this disclosure, however, MWD refers to navigational tools (or "directional tools") that monitor the direction and rate of travel of the tool face during directional drilling operations. Such MWD tools typically include magnetometers and/or accelerometers (colloquially known collectively as a "directional package") for measuring travel and direction of the tool face in relation to vectors of known directional forces such as the Earth's magnetic and gravitational forces. It will be appreciated throughout this disclosure, however, that even though such directional MWD tools are used by way of illustration, this disclosure is not limited to such directional MWD tools in the application of the orienting hanger device also disclosed herein.

MWD tools typically take the form of a substantially uniform cylinder, including a cylindrical sonde containing the directional package, plus other cylindrical components containing items such as batteries and related electronics. The tools' cylindrical shape generally facilitates deployment in a specially-configured section of drill collar to form a "sub" that may be inserted into a conventional drill string. MWD tools may be retrievable or non-retrievable, as described further on in this background. Where retrievable, their cylindrical shape enhances such retrievable deployment.

Directional sensitivity is enabled on the MWD tool, at least in part, by identifying a "high side" on the outside of the tool. More precisely, the "high side" is a radial orientation (or radial azimuth) marked on the outside of the tool that the directional sensors deployed on the inside of the tool will recognize as "top dead center" or "zero degrees tool face". Part of the job of "making up" a bottom hole assembly (BHA) prior to directional drilling includes orienting the MWD tool, within its corresponding sub, so that the high side of the tool is directionally aligned with the intended zero degrees on the tool face. Advantageously the high side of the tool is exactly directionally aligned with zero degrees on the BHA tool face. If not exactly directionally aligned, the misalignment must be precisely known so that appropriate corrections may be made by software in the directional package.

In directional drilling operations using a bent sub, a scribe line on the bent sub will indicate zero degrees tool face. Similarly, in directional drilling operations using a steering tool, the steering tool will have some external physical reference mark indicating its intended zero degrees tool face during use. Conventionally, the scribe line or other reference mark is transferred externally to the collar housing the directional package using, for example, a chalk line, a laser, visual alignment, or similar method. The MWD tool is then oriented within its collar so that its high side aligns with the scribe line or other reference mark as transferred onto the collar.

As noted above, MWD tools come in both retrievable and non-retrievable varieties. "Retrievable" refers to the MWD tool being specially configured to be retrievable from the drill string without tripping the drill string out of the well. The most common retrievable deployment is to locate the MWD tool sub at the very top of the tool string in the BHA, just below the bottom of the drill pipe string, where the top of the MWD tool can be accessed by a wireline run through the hollow drill pipe string from the surface. The end of the wireline provides a hook device which can be attached to a latching device provided on the top of the MWD tool. Once hooked on, the MWD tool can be pulled up and retrieved from inside its collar.

Also as noted above, such a retrievable MWD tool is conventionally cylindrical so that it may be more easily withdrawn from within its collar. Conventionally, external bow springs are provided on the outside of the cylindrical MWD tool, which compress as the MWD tool is inserted into a hole-like receptacle within the collar. The bow springs hold the MWD tool in place in its receptacle, advantageously without rotation with respect to the collar, so to preserve alignment with zero degree tool face of the BHA as described above. External rubber fins on the tool exterior can also be used to position and stabilize an MWD tool (see, e.g., The Pathfinder HDSR). However, if fins are used, a separate internal collar contact is needed to complete the electrical connection of the EM tool. Regardless of the method used, to retrieve conventional tools, the pull on the MWD tool must be sufficient to withdraw the MWD tool longitudinally from its receptacle against the urge of the bow springs.

A primary advantage of retrievable MWD tools is that they are, as noted, retrievable from the drill string without tripping the drill string out of the well. Tripping is a time-consuming process, and to be avoided during drilling operations whenever possible. MWD tools may need to be brought back to the surface before drilling operations are complete for any one of a number of reasons. These reasons include the MWD tool requiring service, or perhaps running out of battery power, or requiring a download of locally-stored data, or even malfunctioning. All of the above tasks may be accomplished without tripping by using a retrievable MWD tool. Furthermore, in situations where the BHA has become stuck in the borehole, it will be appreciated that retrievable MWD tools may be more easily salvaged.

Retrievable MWD tools have a number of disadvantages, however, as compared to non-retrievable MWD tools. In order to promote retrievability, retrievable MWD tools are not easily linked to other downhole measurement devices that may also be located in the tool string in the BHA, such as Logging-While-Drilling (LWD) tools or other MWD tools. Thus, telemetry capability as conventionally found on MWD tools may not also be used in conjunction with such other downhole tools. Further, the conventional bow spring deployment of retrievable tools, as described above, causes the MWD tool to be rotationally immobilized with respect to its surrounding collar only by the force reacting to compression of the bow springs. The potential for differential radial movement between MWD tool and the surrounding collar thus exists, potentially brought about by vibrations caused during drilling operations. In particular, the high vibrations caused by air drilling have an increased potential to undermine the alignment of a conventionally-deployed retrievable MWD tool.

Of course, the disadvantages of conventional retrievable MWD tool deployments as described immediately above may be addressed by deploying a conventional non-retrievable MWD tool. Non-retrievable MWD tools may be mounted more robustly and integratedly in the tool string in the BHA without concern for retrievability.

It will therefore be appreciated from the foregoing background disclosure that there are some drilling applications in which a retrievable MWD tool may be preferable, and other applications in which a non-retrievable MWD may be preferable. From a tool supplier's point of view, it is not always optimal to keep a large inventory of both retrievable and non-retrievable MWD tools. Inventory and manufacturing efficiency can be enhanced when retrievable MWD tools can be optionally converted to non-retrievable MWD tools, thereby enabling use of the same tools in both retrievable and non-retrievable MWD drilling applications.

Techniques are currently known for converting retrievable MWD tools into non-retrievable MWD tools. However, these current techniques tend to be rather cumbersome and unreliable. The conversion is typically accomplished first by threading and torquing one or more orientation devices to the top and/or bottom of a retrievable MWD tool. The orientation devices are generally cylindrical transition pieces which (1) re-dimension the MWD tool assembly to be suitable for being received into a non-retrievable MWD tool mounting device (such as a suitably-configured length of drill collar), and (2) transfer the orientation reference line on the MWD tool onto a corresponding reference line on the mounting device, which can then be used for alignment with the scribe line on the bent sub during make-up of the tool string in the BHA. Adding the orientation devices(s) and the mounting device to the MWD tool thus requires addition of at least two (2) threaded/torqued connections. It will be appreciated that making these additional connections up is inefficient and cumbersome in many applications. Further, it will be appreciated that loss of torque and loosening of the threaded joints during drilling operations will likely cause a misalignment of the MWD tool's directional sensors with the tool face of the BHA.

Thus, there is a need in the art for a conversion device that quickly and nimbly converts a retrievable tool (including a retrievable directional MWD tool) into a corresponding non-retrievable MWD tool that may be mounted in a section of drill collar. The section of drill collar may then be placed in any desired position in the tool string in the BHA. The conversion device should avoid threaded/torqued connections that may loosen during drilling operations and possibly cause a misalignment in orientation of a directional MWD tool.

Advantageously the improved conversion device will accommodate EM MWD tools that include EM telemetry transceivers (and associated architecture and circuitry) on board. In such EM MWD deployments, the conversion device will enable optional mounting of the retrievable EM MWD tool in a gap sub.

SUMMARY AND TECHNICAL ADVANTAGES

This disclosure describes an orienting hanger assembly that addresses at least some of the needs in the art described above in the Background section. This disclosure describes embodiments of an inventive orienting hanger assembly that may be deployed as, for example, a sub in a conventional drill string, and further discloses methods of its use in such exemplary deployments.

The described orienting hanger allows a retrievable MWD tool to be easily converted to a top hanging fixed (non-retrievable) MWD tool without reconfiguring the basic components of the MWD tool. This disclosure describes an assembly that can (1) easily be threaded onto the top of an MWD tool, and (2) hold its orientation with respect to the MWD tool even though the threaded connection between tool and assembly is not necessarily tight. The orientation is maintained via a threaded fastener (nominally, a shear bolt) inserted through a window in the assembly and into a threaded hole in the MWD tool (or into a threaded hole in a tool adapter threaded onto the top of the tool). The shear bolt acting through the window holds the alignment between the MWD tool and the orienting hanger assembly, notwithstanding any radial torque applied to MWD tool or orienting hanger assembly.

Currently preferred embodiments of the orienting hanger assembly further provide an alignment notch that facilitates the hanger (and therefore the MWD tool) to be aligned to reference orientations (such as zero degrees tool face) on the drilling assembly. A key or orientating tool may be engaged in the notch as a physical means for aligning the hanger assembly (and therefore the MWD tool) to the BHA. Once the hanger assembly is rotated with the key to a desired selectable orientation with respect to the BHA, the assembly is locked into such orientation via, for example, external locking screws inserted from the outer diameter of the drill string, or an expandable split ring assembly.

The disclosed orienting hanger assembly thus advantageously deploys a retrievable MWD tool in a non-retrievable environment, while avoiding some of the disadvantages associated with conventional ones of such deployments. Disclosed features, described in greater detail below, enable the high side of the tool to be transferred quickly, reliably and accurately to a scribe line or other directional reference mark transferred conventionally onto the outer collar of the orienting hanger assembly. Further disclosed features, described in greater detail below, enable the selected tool orientation to be locked down quickly and reliably with respect the outer collar, with greater confidence that high vibration during drilling operations will not disturb the selected orientation. Yet further, the MWD tool as deployed in the disclosed orienting hanger is suspended from above during drilling operations and thus "hanging" in space provided below. This "hanging" aspect allows different types of MWD tools of different overall length to be deployed in the orienting hanger assembly without the need for spacers. Data or power connectivity between the MWD tool and other tooling in the BHA is thus further enhanced since there are no spacers causing obstruction.

In a first embodiment, this disclosure describes an orienting hanger assembly comprising a hollow cylindrical outer collar, a hollow cylindrical inner hanger, and a cylindrical MWD tool adapter. The outer collar has first and second ends with a box-end threaded connection at the first end and a pin-end threaded connection at the second end. The outer collar has a substantially constant outer diameter, but there is an annular shoulder on its inner diameter. The internal shoulder separates the inner collar wall into first and second sections, corresponding to the first and second collar ends, in which the second section (pin end) has a smaller diameter than the first section (box end) At least one threaded locking hole extends through the collar wall through to the first inner collar wall section.

The cylindrical inner hanger is disposed to be inserted into the outer collar so that the longitudinal axes of the collar and hanger are aligned. The inner hanger has first and second hanger ends that correspond generally to the first and second collar ends when the hanger is received into the outer collar. The inner hanger has an external annular shoulder that separates the first and second hanger ends and the corresponding first and second outer hanger wall sections. The first outer hanger wall section has a greater diameter than the second outer hanger wall section. The exterior of the first outer hanger wall section includes an annular knurled portion that is located so that it is visible through each of the at least one locking holes when the inner hanger is fully received inside the outer collar. The external shoulder on the hanger is disposed to abut the internal shoulder on the collar when the inner hanger is fully received inside the outer collar (thus, when the collar and inserted hanger are oriented vertically, with their first ends pointing up, the hanger actually "hangs" on the collar shoulder).

The first hanger end also includes an alignment notch provided in the inner wall. The notch is located so that it is visible when the hanger is fully received into the outer collar. At least two opposing radial wings extend outward from the exterior of the second hanger end. The wings terminate with a distal wing face and extend from the surface so that when the inner hanger is received into the outer collar, the distal wing faces are located proximate to and substantially flush with an inner surface of the second inner collar wall section. At least one of the radial wings includes an open wing passage from its distal wing face through to the inner cylindrical surface of the hanger. The alignment notch and the wing providing the wing passage are separated by a predetermined radial offset about the longitudinal hanger axis so that the location of the alignment notch on the circumference of the hanger corresponds (by the predetermined offset) to the location of the wing passage.

The cylindrical MWD tool adapter has first and second adapter ends that correspond to the first and second ends of the collar and hanger. Threads on the outer surface of the first adapter end are disposed to mate with threads on the inner surface of the second hanger end. The tool adapter also has threads on the inner surface of its second end disposed to mate with the external threads on one end of an MWD tool. Additionally, the tool adapter has a radial threaded tool-orienting hole located so that it is visible through the wing passage on the inner hanger when the tool adapter is threaded into the second hanger end.

Once a tool is threaded into the tool adapter, an orienting screw is received through a selected wing passage and tightened into the tool-orienting hole so that a portion of the orienting screw prevents relative rotation of the tool adapter and the inner hanger via contact engagement with the selected wing passage. When the tool and hanger are threaded together by the adapter and fully received into the outer collar, one locking screw is received through each locking hole in the collar. The locking screws are tightened so that they frictionally engage the knurled portion of the hanger and secure it into the outer collar.

In a second embodiment, this disclosure describes an orienting hanger assembly, comprising a generally tubular inner hanger disposed to be received snugly into a generally tubular outer collar and a cylindrical MWD tool adapter. The hanger and collar are configured so that when the inner hanger is fully received into the outer collar (1) the longitudinal axes of the hanger and collar are aligned, (2) an annular internal shoulder provided on the outer collar abuts an annular external shoulder on the inner hanger, and (3) first and second ends of the of the inner hanger generally correspond with first and second ends of the outer collar.

The cylindrical MWD tool adapter has first and second adapter ends. The first adapter end is disposed to threadably engage the second end of the inner hanger, and the second adapter end is disposed to threadably engage an MWD tool. Further, the tool adapter includes a radial threaded tool-orienting hole.

The outer collar has a tubular collar wall, and the first end of the outer collar provides at least one threaded locking hole extending through the collar wall. The inner hanger has a tubular hanger wall, and the first end of the inner hanger provides an annular external knurled portion formed on the hanger wall. The knurled portion and the at least one locking hole are located so that a locking screw can be received through each locking hole and frictionally engage the knurled portion when the inner hanger is fully received into the outer collar. The first end of the inner hanger also includes an interior alignment notch in the inner surface of the hanger wall.

At least two opposing radial wings extend outward from the second end of the inner hanger. Each radial wing terminates at a distal wing face, and the wings have a common radial length such that when the inner hanger is received into the outer collar, the distal wing faces are located snugly next to an inner surface of the second end of the outer collar. At least one of the radial wings includes an open wing passage from its distal wing face through to an inner surface of the inner hanger at its second end. The alignment notch and the radial wing that provides the wing passage are separated by a predetermined radial offset about the longitudinal axis of the inner hanger.

Threadably engaging the tool adapter onto the second end of the inner hanger enables an orienting screw to be received through a selected wing passage and into the tool-orienting hole on the adapter so that a portion of the orienting screw prevents relative rotation of the tool adapter and the inner hanger via contact engagement with the selected wing passage. Box and pin connections are provided on corresponding ones of the first and second ends of the outer collar, suitable to threadably insert the outer collar into a drill string.

In some embodiments of the outer collar, the threaded locking hole in the outer collar may be counter-sunk so that when the locking screws are tightened, they are flush with the outer wall of the collar. Additionally, there may be embodiments of the inner hanger in which the knurled portion is located in an annular recess.

In other embodiments, the threaded locking hole(s) in the outer collar, the locking screw(s) and the knurled portion, may be substituted as an orientation locking assembly for an expandable split ring assembly.

Further embodiments of the inner hanger may provide at least one annular recess on the exterior surface of the hanger which is disposed to receive an o-ring configured to prevent fluid flow in the annular spaces between the inner collar wall outer hanger wall.

Other embodiments of the inner hanger may also provide at least one fluid window through the second hanger wall section to enable fluid flow from inside the inner hanger into the annular space between the hanger and the outer collar when the inner hanger is fully received into the outer collar. These embodiments may further include a surface, on the interior of the inner hanger, shaped to encourage fluid flow from inside the inner hanger through each fluid window.

Additional embodiments of the tool adapter may provide at least one annular recess disposed to receive an o-ring configured to prevent annular fluid flow between the tool adapter and the inner cylindrical surface of the second hanger end when the tool adapter is fully received into the inner hanger.

In a third embodiment, this disclosure describes an orienting hanger assembly as previously described, except that instead of providing threaded locking holes in the collar wall, locking screws, and a knurled portion on the hanger wall, the assembly provides an expandable split ring assembly rigidly affixed to the first end of the inner hanger, the split ring assembly configured, when engaged, to prevent relative rotational displacement between the inner hanger and the outer collar when the inner hanger is fully received into the outer collar.

It will therefore be appreciated from the foregoing disclosure that the orienting hanger assembly, in use, gives rise to inventive methods for deploying a retrievable MWD tool in a non-retrievable environment. One embodiment of the method comprises the steps of: (a) providing an orienting hanger assembly, the orienting hanger assembly including (A) a generally tubular inner hanger disposed to be received snugly into (B) a generally tubular outer collar such that when the inner hanger is fully received into the outer collar (1) a longitudinal axis of the inner hanger coincides with a longitudinal axis of the outer collar, (2) an annular internal shoulder provided on the outer collar abuts an annular external shoulder on the inner hanger, and (3) first and second ends of the of the inner hanger generally correspond with first and second ends of the outer collar, and (C) a cylindrical MWD tool adapter having first and second adapter ends, the tool adapter further including a radial threaded tool-orienting hole; (b) threading and tightening an MWD tool onto the second adapter end of the tool adapter; (c) measuring, if any, a radial offset about a longitudinal MWD tool axis between a high side of the MWD tool and the tool-orienting hole; (d) threading the first adapter end of the tool adapter onto the second end of the inner hanger until the tool-orienting hole is visible through a wing passage in one of at least two opposing radial wings provided on the second end of the inner hanger; (e) receiving an orienting screw through the wing passage; (f) threading and tightening the orienting screw into the tool-orienting hole such that a portion of the orienting screw prevents relative rotation of the tool adapter and the inner hanger via contact engagement with the wing passage; (g) providing an alignment notch in a hanger wall at the first end of the inner hanger such that the wing passage and the alignment notch are separated by a predetermined radial offset about the longitudinal axis of the inner hanger; (h) inserting the outer collar into a bottom hole assembly (BHA) at a pre-desired position therein; (i) transferring a selected degrees tool face orientation of the BHA onto the outer collar; (j) receiving the inner hanger (with the tool adapter and MWD tool attached thereto) into the outer collar such that the MWD tool is suspended from the second end of the inner hanger via abutment and resting of the annular external shoulder on the inner hanger against the annular internal shoulder on the outer collar; (k) rotating the inner hanger with respect to the outer collar such that the alignment notch is orientationally aligned with the selected tool face orientation of the BHA as transferred onto the outer collar in step (i); (l) locking the inner hanger to the outer collar so as to prevent further relative rotation thereof; and (m) if required, correcting directional measurements by the MWD tool for any radial misalignment between the high side of the MWD tool and the alignment notch.

In currently preferred embodiments of the disclosed methods, step (l) may be completed by threading one or more locking screw through a corresponding radial threaded locking hole in the outer collar and frictionally engaging each locking screw on the annular external knurled portion formed on the first end of the internal hanger. For example, the illustrations included with this disclosure show the completion of step (l) by threading three locking screws through three corresponding radial threaded locking holes in the outer collar and frictionally engaging each locking screw on the annular external knurled portion formed on the first end of the internal hanger. It should be noted that this disclosure is not limited to the use of locking screws threaded through the outer collar to lock the inner hanger to the outer collar. Further, the scope of this disclosure is not limited to use of three locking screws, and any suitable number may be used as required to obtain serviceable locking. Other embodiments of the disclosed methods may provide for the completion of step (l) via the use of other locking mechanisms, such as an expandable split ring assembly.

Other embodiments of the disclosed methods may include additional variations. For example, the MWD tool may be an EM MWD tool, and in those embodiments, the outer collar may be an external gap sub. In other cases, the MWD tool may be a retrievable MWD tool. Additionally, in some embodiments, step (i) may be the transferring zero degrees tool face orientation of the BHA onto the outer collar. Correspondingly, in those embodiments, step (k) is rotating the inner hanger with respect to the outer collar such that the alignment notch is orientationally aligned with the zero degree tool face orientation of the BHA as transferred onto the outer collar in step (i). Further, in other embodiments, the predetermined radial offset in step (g) is zero degrees.

Likewise, in particular embodiments of the disclosed methods, step (m) may be accomplished by pre-programmed instructions in the MWD tool, which are embodied in the selected tool's software or firmware. Further, an additional step—step (n)—may be performed in some embodiments of the disclosed methods. Step (n) comprises: connecting the selected MWD tool to at least one other downhole tool, in which the connection enables power communication, data communication, or both, between the selected MWD tool and such other downhole tools.

It is therefore a technical advantage of the disclosed orienting hanger assembly (and its disclosed methods of use) to quickly and robustly align the high side of a directional MWD tool to zero degrees tool face on the bottom hole assembly, or to another user-selected tool face orientation. It will be appreciated from the disclosed design that the MWD tool (with tool adapter attached) need not be threaded down tightly to the second end of the inner hanger. Threading needs to be sufficient to secure the MWD tool adapter from "falling off" the inner hanger, at which point the orienting screw may be located through the radial wing passage in the inner hanger and screwed tightly into the tool-orienting hole in the tool adapter. At this point the tool adapter is restrained from relative rotation with respect to the inner hanger via contact by orienting screw against the wing passage. Thus, the tool adapter cannot now become unthreaded from the inner hanger, even though there may be a less-than-tight threaded connection between the tool adapter and the inner hanger. A tightened or torqued threaded connection between the tool adapter and the inner hanger is thus obviated. Further, since the tool adapter is now restrained from relative rotation with respect to the inner hanger (via contact by the orienting screw against the wing passage), the tool adapter, and therefore the high side of the MWD tool, retains its radial orientation with respect to the radial wing through which the orienting screw is located. Moreover, the length of the orienting screw may be selected so that when the inner hanger (with MWD tool and tool adapter attached) is received into the outer collar, the inner surface of the outer collar prevents the orienting screw (as located in the radial wing passage) from becoming completely unthreaded from the tool adapter.

A first end of the inner hanger is provided with an alignment notch such that the wing passage and the alignment notch share a common radial orientation about the longitudinal axis of the inner hanger. Alternatively, the wing passage and alignment notch may share a known radial orientation misalignment. The scribe line (or other BHA reference point for zero degrees tool face) may then be transferred onto the outer collar via conventional procedure. When inner hanger (with MWD tool and tool adapter attached) is received into the outer collar, a commonly used conventional hand tool may be used to rotate the inner hanger within the outer collar such that the alignment notch becomes rotationally aligned with the scribe line as transferred onto the outer collar. The high side of the MWD tool is thus rotationally aligned with the scribe line via transfer of the MWD tool's rotational alignment through the assembled orienting hanger up to the scribe line, plus or minus any known rotational misalignment between high side and radial wing, between radial wing and alignment notch, and between alignment notch and scribe line.

It will be appreciated that software or firmware, for example, in the MWD tool may correct the tool's directional measurements for known rotational misalignment in operation of the MWD tool in the orienting hanger assembly as deployed in the BHA. In other words, software or firmware enables the correction of any orientational misalignment between the MWD internal directional sensors and the alignment notch as aligned to the BHA.

It should be noted that the scope of this disclosure contemplates that any or all of the radial wings may provided wing passages through which the orienting screw may be located. However, some embodiments of the hanger assembly may provide radial wings in which only one wing includes a wing passage, namely the radial wing (and wing passage) that is separated from the alignment notch by a predetermined radial offset. These embodiments are advantageous to minimize the chance for alignment errors during make-up of the orienting hanger assembly and MWD tool in the drill string. It will be appreciated that when only one wing passage is provided on the hanger assembly, the orienting screw cannot be inserted through the "wrong wing passage" during normal tool alignment operations.

Once the inner hanger has been rotated within the outer collar so that the alignment notch is rotationally aligned with the scribe line that was transferred onto the outer collar, the locking screws are inserted through the locking holes and torqued against the knurled portion on the inner hanger. The torque applied to the locking screws secures the orientation of the collar, hanger, and tool, relative to each other. Typically, torque may be applied using conventional hand tools (e.g., a standard allen wrench). However, in some embodiments for use in high-vibration operations, relatively high torque is necessary and a powered tool may be required.

Further, as noted previously, some embodiments of the disclosed orienting hanger assembly may substitute the locking screw arrangement for an expandable split ring assembly as a feature for locking down a desired orientation.

The above-described summary of alignment of an MWD tool in conjunction with the disclosed orienting hanger assembly improves upon the current art in several regards. Currently, MWD tools are conventionally deployed in a non-retrievable environment via a "landed" approach, rather than a "hanging" approach. Conventionally, a Uniform Bottom Hole Orientation (UBHO) device (also colloquially known as a "mule shoe") receives an MWD tool into a tight-fit receptacle. The MWD tool is oriented within the receptacle so that in normal vertical drilling operations, the tool "drops" vertically all the way into the receptacle. Once received within the receptacle, the high side of the MWD tool may be rotationally aligned with the scribe line transferred onto the UBHO device. Spacer bars are then selected, according to the overall length of the particular MWD tool, to fill up space and hold the "top" end of the tool within the UBHO device. The presence of spacer bars makes it difficult to connect other MWD or LWD tools located elsewhere in the BHA to the MWD tool as deployed in the UBHO device. For EM MWD tools, use of a UBHO device makes the co-location of the tool with internal or external gaps difficult, potentially degrading the quality of EM transmissions.

A further technical advantage of the disclosed orienting hanger assembly (and its disclosed methods of use) is thus to enable directional MWD tools to be more reliably deployed in a hanging environment. As noted earlier in this Summary section, the "hanging" aspect allows different types of MWD tools of different overall length to be deployed in the orienting hanger assembly without the need for spacers. Data or power connectivity between the MWD tool and other tooling in the BHA is thus further enhanced since there are no spacers causing obstruction below the tool. Use of the orienting hanger assembly may further obviate threaded/torqued connections associated with use of a conventional UBHO device.

A further technical advantage of the disclosed orienting hanger assembly (and its disclosed methods of use) arises when an EM MWD tool is used in conjunction with the orienting hanger assembly. It will be understood that improved EM telemetry performance occurs when internal and external gaps are substantially co-located on the BHA. As noted above, such co-location is made difficult by use of a conventional UBHO device. However, in contrast, embodiments of the orienting hanger assembly may provide an external gap on the outer collar. An EM MWD tool having an internal gap on board may be then threaded onto the tool adapter, or a separate internal gap may be concatenated onto the tool adapter with the EM MWD tool. When received into the outer collar, the location of the internal gap thus comes close to co-location with the external gap on the outer collar. However, the orienting hanger assembly can incorporate the gap sub all in one piece or in multiple pieces for easy replacement and service, and this disclosure is not limited in this regard. Further, because of the "hanging" nature of the EM MWD tool inside the outer collar, the actual measured separation between internal and external gaps may be repeatably ordained in sequential deployments of EM MWD tools in the orienting hanger assembly during drilling operations over time.

A further technical advantage of the orienting hanger is that alignment may be preserved in harsh environments for orientation, such as high vibration drilling environments. As previously noted, in embodiments providing locking screws, torque may typically be applied to the locking screws with conventional hand tools (e.g., via a standard allen wrench). This is advantageous because it enables easy replacement of the locking screws. In embodiments providing an expandable split ring assembly as an alternative to locking screws, it will be understood that such split ring assemblies provide tight, robust locking via conventional, straightforward actuation of threaded mechanisms on the assemblies.

A further technical advantage of the disclosed orienting hanger assembly (and its disclosed methods of use) is to enable a more flexible and cost-effective MWD tool asset utilization. As noted above, the orienting hanger enables retrievable MWD tools to be used in non-retrievable environments without many of the disadvantages conventionally associated with such deployments. Thus, with the orienting hanger assembly available, a fleet of retrievable MWD tools has a potentially wider utilization platform, both in conventional retrievable deployments, and further in novel non-retrievable deployments as disclosed herein.

The foregoing has outlined rather broadly the features and technical advantages of the inventive disclosure of this application, in order that the detailed description of the embodiments that follows may be better understood. It will be appreciated by those skilled in the art that the specific embodiments disclosed may be readily utilized as a basis for modifying or designing other structures for carrying out the same general purposes of the inventive material set forth in this disclosure.

BRIEF DESCRIPTION OF THE DRAWINGS

For a more complete understanding of the embodiments described in this disclosure, and their advantages, reference is made to the following detailed description taken in conjunction with the accompanying drawings, in which.

DETAILED DESCRIPTION

Figure 1:
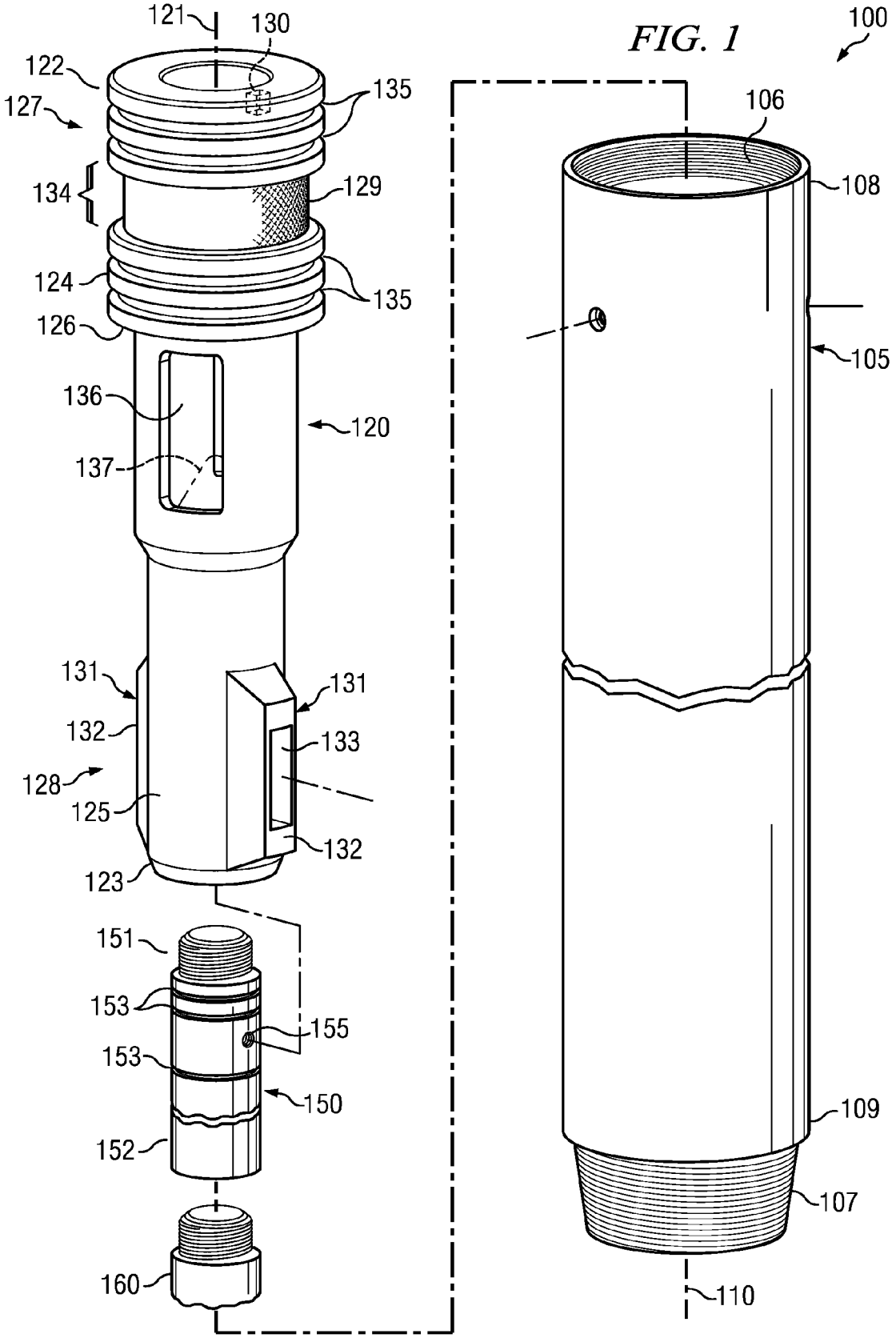
FIG. 1 illustrates, in disassembled form, perspective views of one embodiment of an orienting hanger assembly 100, including an outer collar 105, an inner hanger 120, and a tool adapter 150 for attachment to MWD tool 160 (it being understood that MWD tool 160 is not part of orienting hanger assembly 100)
Figure 2:
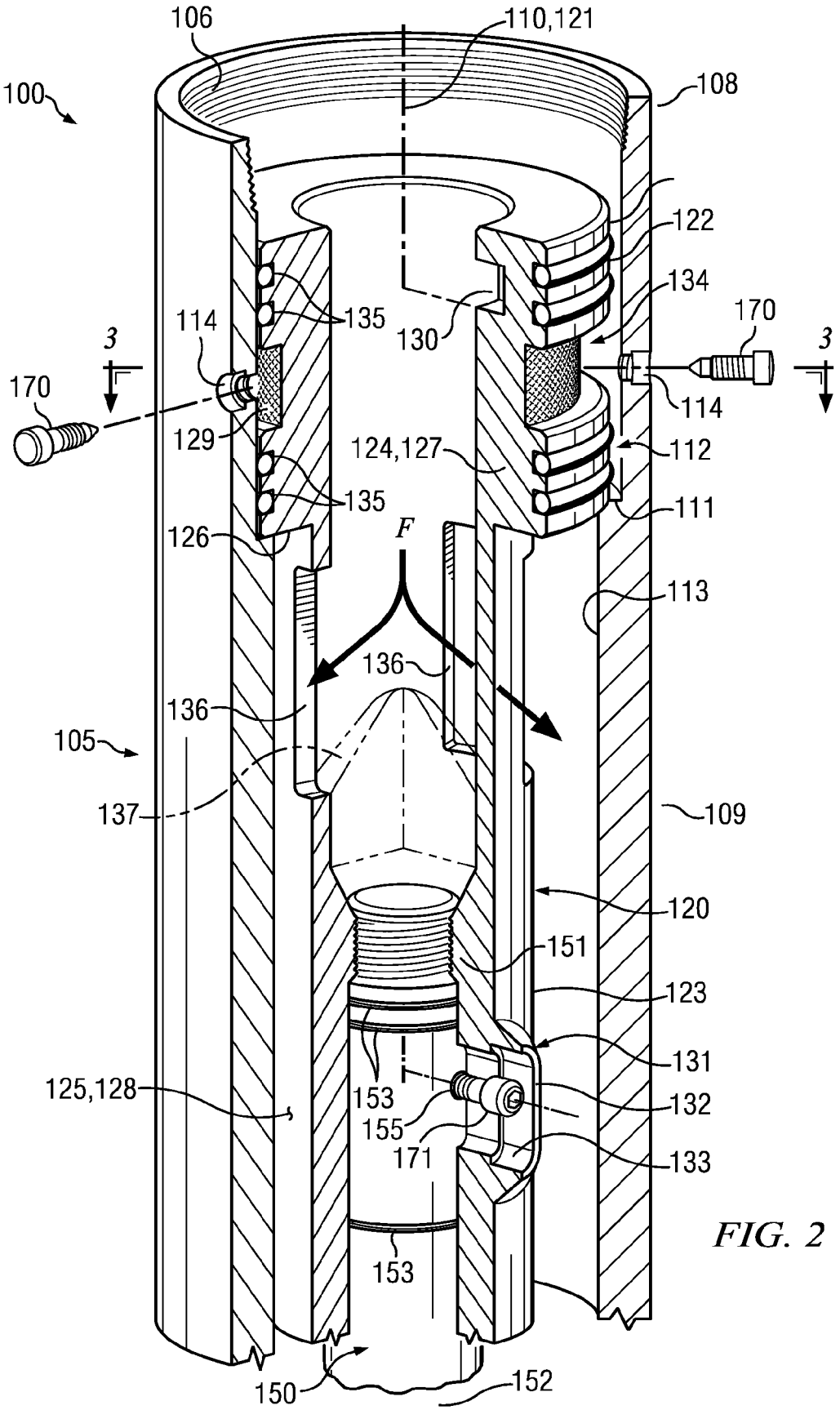
FIG. 2 shows, in cutaway view, the orienting hanger assembly 100 of FIG. 1 in assembled form.
Figure 3:
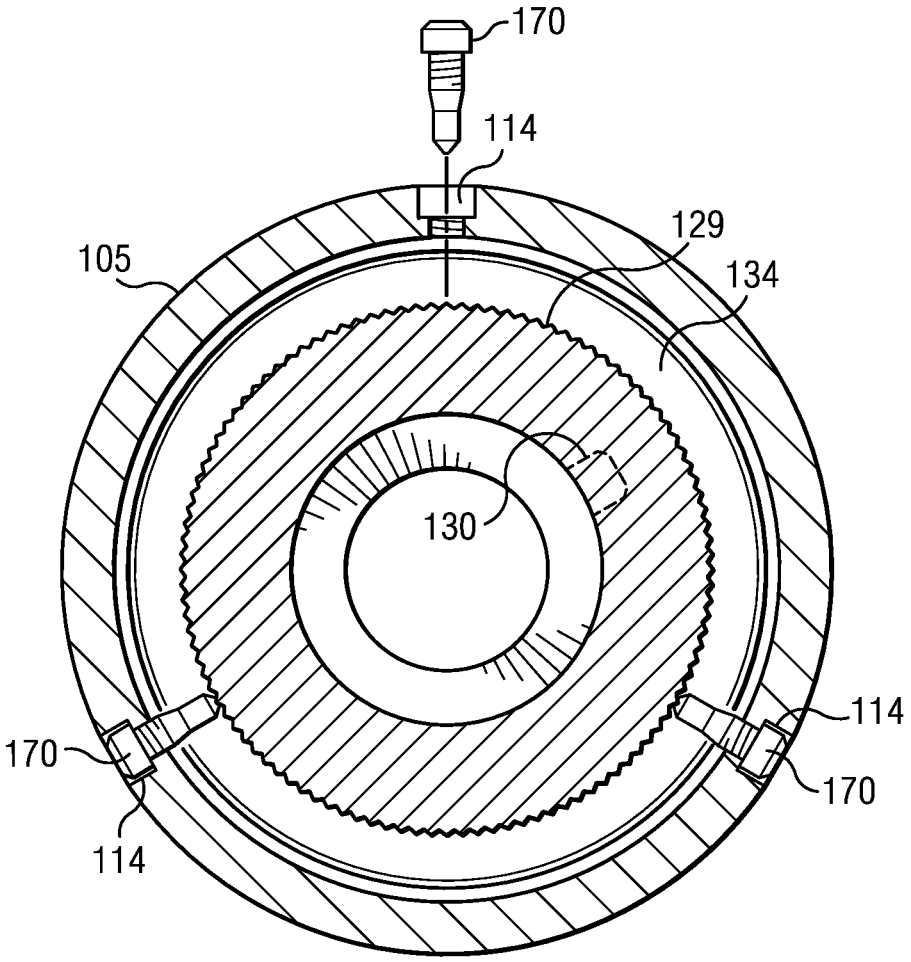
FIG. 3 is a section view of the orienting hanger assembly 100 as shown on FIG. 2.

For the purposes of the following disclosure, FIGS. 1, 2, and 3 should be viewed together. Any part, item, or feature that is identified by part number on one of FIGS. 1-3 has the same part number when illustrated on another of FIGS. 1-3.

FIG. 1 illustrates, in disassembled form, perspective views of one embodiment of an orienting hanger assembly 100. As shown on FIG. 1, the orienting hanger assembly 100 includes a hollow cylindrical outer collar 105, a hollow cylindrical inner hanger 120, and a cylindrical tool adapter 150. Tool adapter 150 is suitable to receive one end of a threaded MWD tool 160, examples of which are described further on in this disclosure. All of outer collar 105, inner hanger 120, and tool adapter 150 can be made from a material such as stainless steel. However, this disclosure is not limited in this regard.

Fully assembled, orienting hanger 100 is disposed to be inserted into a conventional drill string. To enable this insertion, outer collar 105, as shown on FIG. 1, includes a first collar end 108 that provides a threaded box connection 106 and a second collar end 109 that provides a threaded pin connection 107. Consistent with drill string connections known in the art, such conventional pin and box connections enable an assembled orienting hanger 100 to be inserted into a concatenated string of drill collar tubulars. For clarity, threaded pin connection 107 is omitted from outer collar 105 on FIG. 2.

Outer collar 105 has a substantially constant outer diameter about a longitudinal collar axis 110. Outer collar 105, as shown on FIG. 2, includes annular inner collar shoulder 111 that separates the interior of outer collar 105 into a first cylindrical inner collar wall section 112 at first collar end 108 and a second cylindrical inner collar wall section 113 at second collar end 109. The diameter of the second inner collar wall 113 section is less than that of the first inner collar wall section 112, as illustrated on FIG. 2. Outer collar 105, as depicted on FIGS. 1 and 2, also provides at least one radial threaded locking hole 114 (and, as illustrated on FIG. 3, three locking holes 114) extending from the outer wall through to the first inner collar wall section 112.

Inner hanger 120, as shown on FIG. 1, comprises a cylindrical member having a unitary longitudinal hanger axis 121. Inner hanger 120 is disposed to be received inside outer collar 105 so that longitudinal collar axis 110 and longitudinal hanger axis 121 become substantially common, as shown on FIG. 2.

As illustrated on FIG. 2, inner hanger 120 includes first hanger end 122 aligned at first collar end 108 and second hanger end 123 aligned at second collar end 109 when inner hanger 120 is received into outer collar 105. Additionally, FIG. 1 depicts inner hanger 120 including first outer cylindrical hanger wall section 124 at first hanger end 122 and second outer cylindrical hanger wall section 125 at second hanger end 123.

The diameter of first outer hanger wall section 124 is greater than the diameter of second outer hanger wall section 125 and, as depicted on FIGS. 1 and 2, is separated from second outer hanger wall section 125 by an annular outer hanger shoulder 126. Outer hanger shoulder 126 is disposed to abut inner collar shoulder 111 when inner hanger 120 is fully received inside outer collar 105, as shown on FIG. 2.

As shown on FIG. 1, inner hanger 120 is further divided into first hanger portion 127 and second hanger portion 128, which correspond to first outer hanger wall section 124 and second outer hanger wall section 125, respectively. First outer hanger wall section 124 includes an annular knurled portion 129, shown on FIGS. 1, 2, and 3. As illustrated on FIG. 2, knurled portion 129 and locking holes 114 (on outer collar 105) are located so that knurled portion 129 is visible through each locking hole 114 when inner hanger 120 is fully received inside outer collar 105.

Orienting hanger 100 also includes one locking screw 170 disposed to be received through each locking hole 114 and frictionally engage knurled portion 129 when inner hanger 120 is fully received into outer collar 105. As shown on FIGS. 2 and 3, three locking screws 170 are provided, one for each of the three locking holes 114 also provided. This disclosure is not limited, however, to any particular number of locking screws 170 and corresponding locking holes 114. Also, as further described in more detail below, this disclosure is not limited to locking screws 170 as the only manner by which inner hanger 120 may be orientationally locked to outer collar 105. Other embodiments, not illustrated, may instead provide an expandable split ring assembly for orientationally locking inner hanger 120 to outer collar 105.

As shown on FIGS. 1, 2, and 3, the inner surface of first hanger portion 127 also includes an alignment notch 130 at first hanger end 122. Application of a conventional hand tool on alignment notch 130 enables inner hanger 120 to be rotated about longitudinal hanger axis 121 relative to outer collar 105, and thus to be oriented to a selected position relative to outer collar 105 after inner hanger 120 has been fully received into outer collar 105. Any of a number of conventional tools are commercially available to engage alignment notch 130 (e.g., Beefy Alignment Wrench #30-6669B, available from Hunting Specialty Supply of Houston, Tex. at: http://www.hunting-intl.com/hunting-specialty-supply/handling-equipment).

While FIGS. 1, 2, and 3 depict a cube-shaped alignment notch 130, nothing in this disclosure is intended to limit the location or geometry of alignment notch 130 so long as it is effective to engage a tool to orient inner hanger 120 within outer collar 105.

FIGS. 1 and 2 further illustrate inner hanger 120 with a pair of opposing radial wings 131 extending outward from second outer hanger wall section 125 and terminating at a distal wing face 132. Although FIGS. 1 and 2 illustrate two opposing radial wings 131, other embodiments (not illustrated) may provide more than two radial wings 131 in an opposing arrangement around second outer hanger wall section 125. As depicted on FIG. 2, radial wings 131 advantageously have a common radial wing length such that distal wing faces 132 are located proximate to and substantially flush with the inner surface of second inner collar wall section 113 when inner hanger 120 is received into outer collar 105. As will be described in greater detail further below, at least one radial wing 131 provides a wing passage 133 through which an orienting screw 171 is situated. While this disclosure is not specific to any specific separation between distal wing faces 132 and the inner surface of second inner collar wall section 113, it will be understood from FIG. 2 to be close enough so that the inner surface of second inner collar wall section 113 retains orienting screw 171 within wing passage 133 when inner hanger 120 is received into outer collar 105.

As just noted, and as shown on FIGS. 1 and 2, at least one radial wing 131 includes an open wing passage 133 from its distal wing face 132 through to the inner surface of second hanger portion 128. FIGS. 1 and 2 also show that alignment notch 130 and the radial axis of the radial wing 131 that includes wing passage 133 share a common radial orientation about longitudinal hanger axis 121. In alternative embodiments (not illustrated), alignment notch 130 and the radial axis of the radial wing 131 that includes wing passage 133 may be offset by a predetermined radial misalignment, which, if present, must be accounted for in aligning the high side of MWD tool 160 to alignment notch 130.

Tool adapter 150, as shown on FIGS. 1 and 2, is a cylindrical member having first adapter end 151 and second adapter end 152. The outer surface of first adapter end 151 provides threads disposed to mate with threads on the inner surface of second hanger portion 128, as illustrated on FIG. 2. The inner surface of second adapter end 152 provides threads (not visible on FIGS. 1 and 2) disposed to mate with threads provided on one end of an MWD tool. In preferred embodiments, the MWD tool is a retrievable MWD tool such as, by way of example, one of the Electro-Trac EM system of EM telemetry tools available from GE Oil & Gas (http://www.ge-energy.com/products_and_services/products/drilling_measurements/electro_trac_em_mwd_system.jsp). However, it will be appreciated that this disclosure is not limited in this regard and that any suitable MWD or LWD tool may be used.

Tool adapter 150 also includes a radial threaded tool-orienting hole 155, located on the tool adapter to be visible through wing passage 133 when tool adapter 150 is threaded into second hanger end 123, as shown on FIG. 2. As noted above, FIG. 2 also illustrates orienting screw 171 disposed to be received through a selected wing passage 133 and into tool-orienting hole 155. As shown on FIG. 2, a portion of orienting screw 171, when received into tool-orienting hole 155, prevents relative rotation of tool adapter 150 and inner hanger 120 via contact engagement with selected wing passage 133.

In preferred embodiments, orienting screw 171 engages selected wing passage 133 such that negligible relative rotation, and in any case no more than one degree of relative rotation, is possible. However, it will be appreciated that this disclosure is not limited in this regard and that any desired range of relative rotation between tool adapter 150 and inner hanger 120 may be achieved by selecting different geometries for wing passage 133 and orienting screw 171.

The common radial orientation of alignment notch 130 and the radial axis of the radial wing 131 that includes wing passage 133 enables an MWD tool with a known high side to be threaded into orienting hanger assembly 100 via the use of tool adapter 150 and to have its high side oriented to a known reference point on the exterior of orienting hanger assembly 100. To accomplish this orientation, the MWD tool is threaded into tool adapter 150. The adapter is then threaded into inner hanger and secured with orienting screw 171. The high point of the MWD tool is thereby oriented to alignment notch 130 because wing passage 133 (and therefore the high side of the MWD tool, including any known offset) and alignment notch 130 are radially aligned. Alignment notch 130 can then be aligned (oriented) with the scribe line transferred up from a bent sub or motor steering tool with which orienting hanger 100 is associated. Thus, the high side of the MWD tool may be aligned to the scribe line on the bent sub or motor steering tool. This orientation process is more fully described below with reference to disclosed methods.

The following paragraphs describe further alternative embodiments of the orienting hanger assembly 100 that are considered within the scope of this disclosure.

As shown on FIGS. 1, 2, and 3, the locking holes 114 may be countersunk so that locking screws 170 are flush with the outside of outer collar 105, which protects them while the orienting hanger assembly 100 is deployed in drilling operations. Also, as shown on FIGS. 1, 2, and 3, knurled portion 129 may be located in an annular recess 134 in first hanger portion 127.

As has been noted in several places in this disclosure, the scope of the disclosed orienting hanger assembly is not limited to the use of locking screws 170, locking holes 114 and knurled portion 129 as shown on FIGS. 1-3 as a cooperating structure to lock inner hanger 120 to outer collar 105 when inner hanger 120 is full received into outer collar 105. A conventional expandable split ring assembly (not illustrated) may be used instead of locking screws 170, locking holes 114 and knurled portion 129 to lock inner hanger 120 to outer collar 105. It will be understood that such a split ring assembly may be rigidly affixed to first hanger end 122 with opposing C-shaped members disposed to circumferentially engage first inner collar wall section 112. As is known conventionally, a threaded mechanism on the split ring assembly may be actuated so as to cause the C-shaped members to extend (i.e. to separate apart) or to retract back together. It will be appreciated that actuation of the threaded mechanism will cause split ring assembly to rotationally lock and unlock inner hanger 120 and outer collar 105 as desired. Thus, when inner hanger 120 has been aligned with outer collar 105 in accordance with this disclosure, actuation of the threaded mechanism on the split ring assembly will case inner hanger 120 and outer collar 105 to become orientationally locked. It is understood in the applicable art that such split ring locks are tight and robust, even in high vibration environments.

It should be noted that if used, the split ring assembly should be selected and installed on first hanger end 122 so as not to impede engagement and operation of a suitable hand tool on alignment notch 130.

Additionally, as illustrated on FIGS. 1 and 2, first hanger portion 127 may include at least one annular recess 135 disposed to receive an o-ring configured to prevent annular fluid flow between first inner collar wall section 112 and first outer hanger wall section 124 when the inner hanger is received into the outer collar. While FIGS. 1 and 2 depict four annular recesses 135 (two above annular recess 134 and two more below it), nothing in this disclosure should be interpreted to limit the number, geometry, or location of any annular recess 134 or 135.

In some embodiments, orienting hanger assembly 100 may include at least one fluid window 136 cut through second hanger portion 128 to enable fluid flow from inside inner hanger 120 to inside outer collar 105 when inner hanger 120 is fully received into outer collar 105, as shown by arrow F on FIG. 2. While FIGS. 1 and 2 depict two fluid windows 136, nothing in this disclosure should be interpreted to limit the number, geometry, or location of any fluid window 136.

Additionally, embodiments of orienting hanger assembly 100 that include a fluid window 136 may also include a flow enhancer 137 on the inner surface of second hanger portion 128. Flow enhancer 137 may be shaped to encourage fluid flow from inside inner hanger 105 through each fluid window 136 when inner hanger 120 is fully received into outer collar 105.

As shown on FIGS. 1 and 2, flow enhancer 137 is a symmetrical convex surface rising axially toward first hanger end 122. Nonetheless, it should be understood that this disclosure is not limited to the geometry shown on FIGS. 1 and 2 and other corresponding geometries effective to enhance fluid flow F are also within the scope of this disclosure.

Other embodiments of tool adapter 150 include at least one annular recess 153 disposed to receive an o-ring configured to prevent annular fluid flow between tool adapter 150 and the inner surface of second hanger portion 128 when tool adapter 150 is fully received into inner hanger 120.

Figure 4:
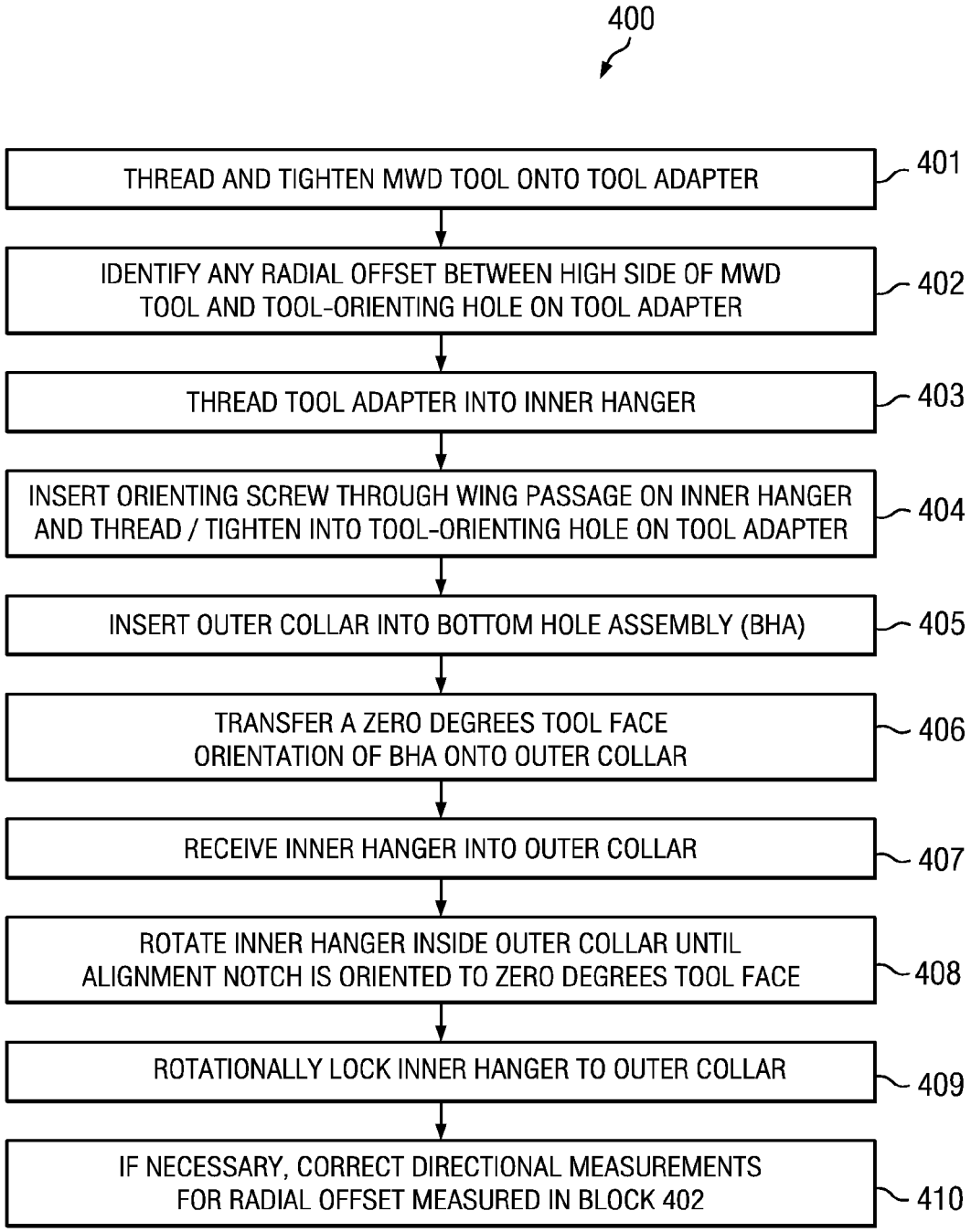
FIG. 4 is a flow chart illustrating one embodiment of a method of deploying an MWD tool in an orienting hanger assembly such as orienting hanger assembly 100 illustrated with reference to FIGS. 1-3.

The scope of this disclosure further includes methods for using an orienting hanger assembly in a bottom hole assembly (BHA). Advantageously, the previously described embodiments of the orienting hanger may be used in such methods although the methods disclosed are not limited solely to use of the embodiments of the orienting hanger disclosed in FIGS. 1-3 and the associated description. Further, although the disclosed methods contemplate embodiments in which a retrievable MWD tool is deployed in a non-retrievable environment, the methods are again not limited in this regard. FIG. 4 is a flow chart in which blocks 401 through 410 represent steps of the method in summary form, and as described in greater detail in the written disclosure immediately below.

The following detailed description refers generally to FIG. 4 and describes a method of using orienting hanger assembly 100 such as described with reference to FIGS. 1-3. In summary, orienting hanger assembly 100 is described above with reference to FIGS. 1-3 as comprising a generally tubular inner hanger 120, a generally tubular outer collar 105, and a generally cylindrical MWD tool adapter 150. Inner hanger 120 is disposed to be received snugly into outer collar 105 such that when it is fully received into outer collar 105, the longitudinal axes of inner hanger 120 and outer collar 105 coincide. Additionally, an annular external shoulder 126 on inner hanger 120 abuts an annular internal shoulder 111 provided on outer collar 105 so that first hanger end 122 and second end 123 generally correspond with first collar 108 and second collar end 109. Tool adapter 150 has first adapter end 151, second adapter end 152, and radial threaded tool-orienting hole 155 that enables an MWD tool to be attached in a pre-selected orientation, as described further below.

Moving on now to a first embodiment of the disclosed methods, and with reference to FIG. 4, block 401 on FIG. 4 refers to the step of threading and tightening MWD tool 160 onto tool adapter 150 via threads on the internal surface of second adapter end 152. Generally, MWD tool 160 may be a retrievable EM MWD tool (an example is described above), but this disclosure is not limited in this regard.

Once MWD tool 160 is tightened onto tool adapter 150, the next step is to measure and record any radial offset about the longitudinal MWD tool axis that exists between the high side of MWD tool 160 and tool-orienting hole 155 on tool adapter 150 (block 402). First adapter end 151 is then threaded onto inner hanger 120 at second hanger end 123 until tool-orienting hole 155 is visible through wing passage 133 in one of at least two opposing radial wings 131 provided on second hanger end 123 (block 403).

Block 404 on FIG. 4 refers to the step of threading orienting screw 171 through wing passage 133 and tightening it into tool-orienting hole 155 on tool adapter 150 such that a portion of orienting screw 171 prevents relative rotation of tool adapter 150 and inner hanger 120 via contact engagement with wing passage 133.

Block 405 refers the step of inserting outer collar 105 into a bottom hole assembly (BHA), via pin end connection 107 on outer collar 105. In some embodiments, outer collar 105 may be an external electrical isolation gap sub, but this disclosure is not limited in this regard.

The next step is to transfer a selected tool face orientation of the BHA onto outer collar 105 (block 406). Conventional methodology may be used accomplish this step. The selected orientation may be ordained by the scribe line on a bent sub or by a suitable reference mark on a steering tool. In the embodiment of the disclosed methods illustrated on FIG. 4, the user-selected tool face orientation transferred onto outer collar 105 is the zero degrees orientation, but this disclosure is not limited in this regard.

In the next step, inner hanger 120, with tool adapter 150 and MWD tool 160 attached, is received into outer collar 105, through first collar end 108, such that MWD tool 160 is suspended from second hanger end 123 via abutment and resting of outer hanger shoulder 126 against inner collar shoulder 111 (block 407). At this point, it is advantageous to make data or power connections between MWD tool 160 and any additional downhole tools elsewhere in the BHA, if so desired.

Block 408 refers to the step of using a conventional hand tool (such as described above) on alignment notch 130 to rotate inner hanger 120 within outer collar 105 such that alignment notch 130 is rotationally aligned with the BHA scribe line as transferred onto outer collar 105 in the step described in block 406. Inner hanger 120 is then rotationally locked to outer collar 105 (block 409) by threading at least one locking screw 170 through a corresponding radial threaded locking hole 114 in outer collar 105 and frictionally engaging each locking screw 170 on annular knurled portion 129 formed on the exterior of first hanger end 122. In the embodiment of orienting hanger assembly 100 depicted on FIG. 3, this step is accomplished by using three locking screws 170, but this disclosure is not limited in this regard. As described above, in other embodiments, an expandable split ring assembly (not illustrated) may be provided on orienting hanger assembly 100 instead of the functional locking combination of locking screws 170, knurled portion 129 and locking holes 114. The split ring assembly will be understood to be rigidly attached to first hanger end 122 and configured, when engaged, to prevent relative rotational displacement between inner hanger 120 and outer collar 105 when inner hanger 120 is fully received into outer collar 105.

The next step, as illustrated in block 410, and only if necessary, is to correct the directional measurements made by MWD tool 160 for the radial offset measured in block 402. This may be completed by software or firmware native to MWD tool 160, but again this disclosure is not limited in this regard. Further, although not illustrated on FIG. 4, this correcting step also includes, if required, correcting for any radial misalignment between the high side of MWD tool 160 and alignment notch 130 (including correcting for any radial misalignment between wing passage 133 and alignment notch 130).

Although the inventive material in this disclosure has been described in detail along with some of its technical advantages, it will be understood that various changes, substitutions and alternations may be made to the detailed embodiments without departing from the broader spirit and scope of such inventive material as set forth in the following claims.

We claim:

1. A method for deploying a retrievable measurement-while-drilling (MWD) tool in an orienting hanger assembly, the method comprising:

providing an orienting hanger assembly, the orienting hanger assembly comprising:

a generally tubular inner hanger disposed to be received into a generally tubular outer collar such that when the inner hanger is fully received into the outer collar a longitudinal axis of the inner hanger coincides with a longitudinal axis of the outer collar, an annular internal shoulder provided on the outer collar abuts an annular external shoulder on the inner hanger, and first and second ends of the inner hanger generally correspond with first and second ends of the outer collar, and a cylindrical MWD tool adapter having first and second adapter ends, the tool adapter further comprising a radial threaded tool-orienting hole;

threading and tightening a MWD tool onto the second adapter end of the tool adapter;

measuring, if any, a radial offset about a longitudinal MWD tool axis between a high side of the MWD tool and the tool-orienting hole;

threading the first adapter end of the tool adapter onto the second end of the inner hanger until the tool-orienting hole is visible through a wing passage in one of at least two opposing radial wings provided on the second end of the inner hanger;

receiving an orienting screw through the wing passage;

threading and tightening the orienting screw into the tool-orienting hole such that a portion of the orienting screw prevents relative rotation of the tool adapter and the inner hanger via contact engagement with the wing passage;

providing an alignment notch in a hanger wall at the first end of the inner hanger such that the wing passage and the alignment notch are separated by a predetermined radial offset about the longitudinal axis of the inner hanger;

inserting the outer collar into a bottom hole assembly (BHA) at a pre-desired position therein;

transferring a selected tool face orientation of the BHA onto the outer collar;

receiving the inner hanger, wherein the tool adapter and MWD tool are attached to the inner hanger, into the outer collar such that the MWD tool is suspended from the second end of the inner hanger via abutment and resting of the annular external shoulder on the inner hanger against the annular internal shoulder on the outer collar;

rotating the inner hanger with respect to the outer collar such that the alignment notch is orientationally aligned with the selected tool face orientation of the BHA as transferred onto the outer collar in;

locking the inner hanger to the outer collar so as to prevent further relative rotation thereof; and if required, correcting directional measurements by the MWD tool for any radial misalignment between the high side of the MWD tool and the alignment notch.

2. The method of claim 1, wherein locking the inner hanger to the outer collar so as to prevent further relative rotation thereof is accomplished by a locking technique selected from the group consisting of:

threading at least one locking screw through a corresponding radial threaded locking hole in the outer collar and frictionally engaging each locking screw on an annular external knurled portion formed on the first end of the internal hanger, threading three locking screws each through a corresponding one of three radial threaded locking holes in the outer collar and frictionally engaging each locking screw on an annular external knurled portion formed on the first end of the internal hanger, and expanding a split ring assembly rigidly affixed to the first end of the inner hanger.

3. The method of claim 1, wherein the MWD tool is an Electromagnetic MWD tool.

4. The method of claim 3, wherein the outer collar is an external gap sub.

5. The method of claim 1, wherein the selected tool face orientation in the step of transferring the selected tool face orientation of the BHA onto the outer collar is zero degrees tool face.

6. The method of claim 1, wherein correcting directional measurements by the MWD tool for any radial misalignment between the high side of the MWD tool and the alignment notch is accomplished by pre-programmed instructions in the MWD tool, and, wherein the pre-programmed instructions are embodied in a format selected from the group consisting of: software and firmware.

7. The method of claim 1, wherein the predetermined radial offset is zero degrees.

8. The method of claim 1, further comprising:

connecting the MWD tool to at least one other downhole tool so as to enable at least one communication selected from the group consisting of: power communication and data communication.

9. The method of claim 1, wherein the MWD tool is a retrievable MWD tool deployed in a non-retrievable environment.

10. A method for aligning a high side of an measurement-while-drilling (MWD) tool, as deployed in a bottom hole assembly, with zero degrees tool face on the bottom hole assembly, the method comprising:

providing an orienting hanger assembly, the orienting hanger assembly comprising:

a generally tubular inner hanger disposed to be received into a generally tubular outer collar such that when the inner hanger is fully received into the outer collar a longitudinal axis of the inner hanger coincides with a longitudinal axis of the outer collar, an annular internal shoulder provided on the outer collar abuts an annular external shoulder on the inner hanger, and first and second ends of the of the inner hanger generally correspond with first and second ends of the outer collar, and a cylindrical MWD tool adapter having first and second adapter ends, the tool adapter further comprising a radial threaded tool-orienting hole;

threading and tightening an MWD tool onto the second adapter end of the tool adapter;

measuring, if any, a radial offset about a longitudinal MWD tool axis between a high side of the MWD tool and the tool-orienting hole;

threading the first adapter end of the tool adapter onto the second end of the inner hanger until the tool-orienting hole is visible through a wing passage in one of at least two opposing radial wings provided on the second end of the inner hanger;

receiving an orienting screw through the wing passage;

threading and tightening the orienting screw into the tool-orienting hole such that a portion of the orienting screw prevents relative rotation of the tool adapter and the inner hanger via contact engagement with the wing passage;

providing an alignment notch in a hanger wall at the first end of the inner hanger such that the wing passage and the alignment notch are separated by a predetermined radial offset about the longitudinal axis of the inner hanger;

inserting the outer collar into a bottom hole assembly (BHA) at a pre-desired position therein;

transferring a zero degrees tool face orientation of the BHA onto the outer collar;

receiving the inner hanger, wherein the tool adapter and MWD tool are attached to the inner hanger, into the outer collar such that the MWD tool is suspended from the second end of the inner hanger via abutment and resting of the annular external shoulder on the inner hanger against the annular internal shoulder on the outer collar;

rotating the inner hanger with respect to the outer collar such that the alignment notch is orientationally aligned with the selected tool face orientation of the BHA as transferred onto the outer collar;

locking the inner hanger to the outer collar so as to prevent further relative rotation thereof; and if required, correcting directional measurements by the MWD tool for any radial misalignment between the high side of the MWD tool and the alignment notch.

11. The method of claim 10, wherein the step of locking the inner hanger to the outer collar so as to prevent further relative rotation thereof is accomplished by a locking technique selected from the group consisting of:

threading at least one locking screw through a corresponding radial threaded locking hole in the outer collar and frictionally engaging each locking screw on an annular external knurled portion formed on the first end of the internal hanger, threading three locking screws each through a corresponding one of three radial threaded locking holes in the outer collar and frictionally engaging each locking screw on an annular external knurled portion formed on the first end of the internal hanger, and expanding a split ring assembly rigidly affixed to the first end of the inner hanger.

12. The method of claim 10, wherein the MWD tool is an Electromagnetic MWD tool.

13. The method of claim 12, wherein the outer collar is an external gap sub.

14. The method of claim 10, wherein correcting directional measurements by the MWD tool for any radial misalignment between the high side of the MWD tool and the alignment notch is accomplished by pre-programmed instructions in the MWD tool, and wherein the pre-programmed instructions are embodied in a format selected from the group consisting of: software and firmware.

15. The method of claim 10, wherein the predetermined radial offset is zero degrees.

16. The method of claim 10, further comprising:

connecting the MWD tool to at least one other downhole tool, wherein the connection enables at least one communication selected from the group consisting of: power communication and data communication.

17. The method of claim 10, wherein the MWD tool is a retrievable MWD tool.

18. A method for deploying a retrievable measurement-while-drilling (MWD) tool in an orienting hanger assembly, the method comprising:

providing an orienting hanger assembly, the orienting hanger assembly comprising:

a generally tubular inner hanger disposed to be received into a generally tubular outer collar such that when the inner hanger is fully received into the outer collar a longitudinal axis of the inner hanger coincides with a longitudinal axis of the outer collar, an annular internal shoulder provided on the outer collar abuts an annular external shoulder on the inner hanger, and first and second ends of the of the inner hanger generally correspond with first and second ends of the outer collar; and a cylindrical MWD tool adapter having first and second adapter ends, the tool adapter further comprising a radial threaded tool-orienting hole;

threading and tightening an MWD tool onto the second adapter end of the tool adapter;

measuring, if any, a radial offset about a longitudinal MWD tool axis between a high side of the MWD tool and the tool-orienting hole;

threading the first adapter end of the tool adapter onto the second end of the inner hanger until the tool-orienting hole is visible through a wing passage in one of at least two opposing radial wings provided on the second end of the inner hanger;

receiving an orienting screw through the wing passage;

threading and tightening the orienting screw into the tool-orienting hole such that a portion of the orienting screw prevents relative rotation of the tool adapter and the inner hanger via contact engagement with the wing passage;

providing an alignment notch in a hanger wall at the first end of the inner hanger such that the wing passage and the alignment notch share a common radial orientation about the longitudinal axis of the inner hanger;

inserting the outer collar into a bottom hole assembly (BHA) at a pre-desired position therein;

transferring a selected tool face orientation of the BHA onto the outer collar;

receiving the inner hanger, wherein the tool adapter and MWD tool are attached to the inner hanger, into the outer collar such that the MWD tool is suspended from the second end of the inner hanger via abutment and resting of the annular external shoulder on the inner hanger against the annular internal shoulder on the outer collar;

rotating the inner hanger with respect to the outer collar such that the alignment notch is orientationally aligned with the selected tool face orientation of the BHA as transferred onto the outer collar in;

locking the inner hanger to the outer collar so as to prevent further relative rotation thereof; and if required, correcting directional measurements by the MWD tool for any radial misalignment between the high side of the MWD tool and the alignment notch.

19. The method of claim 10, wherein correcting directional measurements by the MWD tool for any radial misalignment between the high side of the MWD tool and the alignment notch is accomplished by pre-programmed instructions in the MWD tool, and wherein the pre-programmed instructions are embodied in a format selected from the group consisting of: software and firmware.

20. The method of claim 10, further comprising:

connecting the MWD tool to at least one other downhole tool, wherein the connection enables at least one communication selected from the group consisting of: power communication and data communication.

* * * * *